US010879598B2

(12) United States Patent
Nagashima

(10) Patent No.: US 10,879,598 B2
(45) Date of Patent: Dec. 29, 2020

(54) ANTENNA UNIT

(71) Applicant: Yazaki Corporation, Tokyo (JP)

(72) Inventor: Yoshikazu Nagashima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 46 days.

(21) Appl. No.: 15/896,278

(22) Filed: Feb. 14, 2018

(65) Prior Publication Data

US 2018/0294555 A1 Oct. 11, 2018

(30) Foreign Application Priority Data

Apr. 5, 2017 (JP) ..... 2017-075413

(51) Int. Cl.

| | |
|---|---|
| ***H01Q 1/32*** | (2006.01) |
| ***H01Q 1/40*** | (2006.01) |
| ***H01Q 21/28*** | (2006.01) |
| ***H01Q 5/335*** | (2015.01) |
| ***H01Q 9/42*** | (2006.01) |
| ***H01Q 1/36*** | (2006.01) |
| ***H01Q 1/38*** | (2006.01) |
| ***H01Q 1/12*** | (2006.01) |
| ***H01Q 1/42*** | (2006.01) |
| *H01Q 23/00* | (2006.01) |

(52) U.S. Cl.

CPC ..... *H01Q 1/3208* (2013.01); *H01Q 1/1214* (2013.01); *H01Q 1/3275* (2013.01); *H01Q 1/3291* (2013.01); *H01Q 1/36* (2013.01); *H01Q 1/38* (2013.01); *H01Q 1/405* (2013.01); *H01Q 1/42* (2013.01); *H01Q 5/335* (2015.01); *H01Q 9/42* (2013.01); *H01Q 21/28* (2013.01); *H01Q 23/00* (2013.01)

(58) Field of Classification Search

CPC .. H01Q 1/1214; H01Q 1/3208; H01Q 1/3275; H01Q 1/3291; H01Q 1/405; H01Q 21/28

See application file for complete search history.

(56) References Cited

U.S. PATENT DOCUMENTS

| | | | | |
|---|---|---|---|---|
| 5,532,709 A * | 7/1996 | Talty | ..... | H01Q 1/3233 343/713 |
| 6,118,410 A * | 9/2000 | Nagy | ..... | H01Q 1/1271 343/700 MS |
| 2003/0117328 A1* | 6/2003 | Sievenpiper | ..... | H01Q 1/3275 343/713 |

(Continued)

FOREIGN PATENT DOCUMENTS

JP 2004-289578 A 10/2004

*Primary Examiner* — Daniel Munoz
(74) *Attorney, Agent, or Firm* — Sughrue Mion, PLLC

(57) ABSTRACT

An antenna unit includes a planar antenna portion, a planar coaxial line portion, and position fixing portions. The planar antenna portion includes planar antennas installed at the inner side of an exterior (for example, a roof panel) of a vehicle, the exterior allowing electric waves to be transmitted therethrough, and a first base portion supporting the planar antennas. The planar coaxial line portion includes second wiring patterns connected to the planar antennas and a second base portion connected to the first base portion and supporting the second wiring patterns. The position fixing portions fix the positions of the planar antenna portion and the planar coaxial line portion onto the exterior.

20 Claims, 4 Drawing Sheets

(56) References Cited

U.S. PATENT DOCUMENTS

| | | | | |
|---|---|---|---|---|
| 2004/0036658 | A1* | 2/2004 | Schlieber | H01Q 1/3275<br>343/713 |
| 2006/0109178 | A1* | 5/2006 | Takeuchi | H01Q 1/1271<br>343/700 MS |
| 2007/0171137 | A1* | 7/2007 | Mierzwa | H01Q 1/288<br>343/713 |
| 2009/0167620 | A1* | 7/2009 | Ha | H01Q 1/3291<br>343/711 |
| 2014/0210231 | A1* | 7/2014 | Timmermann | B60J 1/18<br>296/146.15 |
| 2017/0317409 | A1* | 11/2017 | Ayatollahi | H01Q 5/25 |

* cited by examiner

ANTENNA UNIT

CROSS-REFERENCE TO RELATED APPLICATION(S)

The present application claims priority to and incorporates by reference the entire contents of Japanese Patent Application No. 2017-075413 filed in Japan on Apr. 5, 2017.

BACKGROUND OF THE INVENTION

1. Field of the Invention

The present invention relates to an antenna unit.

2. Description of the Related Art

Conventionally, antenna units for transmitting and receiving information to and from the outside of vehicles are installed on vehicles in some cases. Antenna units for vehicles are available that are installed in such a manner that project to the outside of roof panels of the vehicles, for example. As a technique related to the antenna unit, for example, Japanese Patent Application Laid-open No. 2004-289578 discloses an antenna unit of a portable electronic apparatus, the antenna unit including an antenna portion and a connection wire connected to the antenna portion.

The antenna unit for the vehicle is desired to be installed in the vehicle from the viewpoint of mountability on the vehicle, for example. In this case, the antenna unit for the vehicle may be installed at the inner side of an exterior of the vehicle, such as the roof panel made of resin. An installation space of the antenna unit is however limited and there is a further room for improvement in installation of the antenna unit at the inner side of the exterior.

SUMMARY OF THE INVENTION

The present invention has been made in view of the above-described circumstances and an object thereof is to provide an antenna unit capable of being properly installed at the inner side of an exterior of a vehicle.

In order to solve the above mentioned problem and achieve the object, an antenna unit according to one aspect of the present invention includes a planar antenna portion that includes a planar antenna installed at an inner side of an exterior of a vehicle, the exterior allowing electric waves to be transmitted therethrough, the planar antenna transmitting or receiving the electric waves, and a first base portion supporting the planar antenna; a planar wiring portion that includes a conductor formed into a linear shape and connected to the planar antenna, and a second base portion connected to the first base portion and supporting the conductor; and a position fixing portion that fixes positions of the planar antenna portion and the planar wiring portion to the exterior.

According to another aspect of the present invention, in the antenna unit, it is preferable that at least one of the first base portion and the second base portion includes a reinforcing portion, and the reinforcing portion is higher in rigidity than portions of at least one of the first base portion and the second base portion other than the reinforcing portion.

According to still another aspect of the present invention, in the antenna unit, it is preferable that the first base portion is an insulating body and a ground is formed on the first base portion at a side opposite to a side at which the planar antenna is provided.

According to still another aspect of the present invention, in the antenna unit, it is preferable to further comprise a connection component connected to the conductor at a side opposite to the planar antenna.

According to still another aspect of the present invention, in the antenna unit, it is preferable that the position fixing portion includes a mounting portion that mounts, at the inner side of the exterior, the planar antenna portion and the planar wiring portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A mode for carrying out the present invention (embodiment) will be described in detail with reference to the drawings. Contents that are described in the following embodiment do not limit the present invention. Components described below include components that those skilled in the art can easily suppose and substantially the same components. Furthermore, configurations described below can be appropriately combined with one another. Various omissions, replacements, or changes of the configurations can be made in a range without departing from the gist of the present invention.

Embodiment

Figure 1:
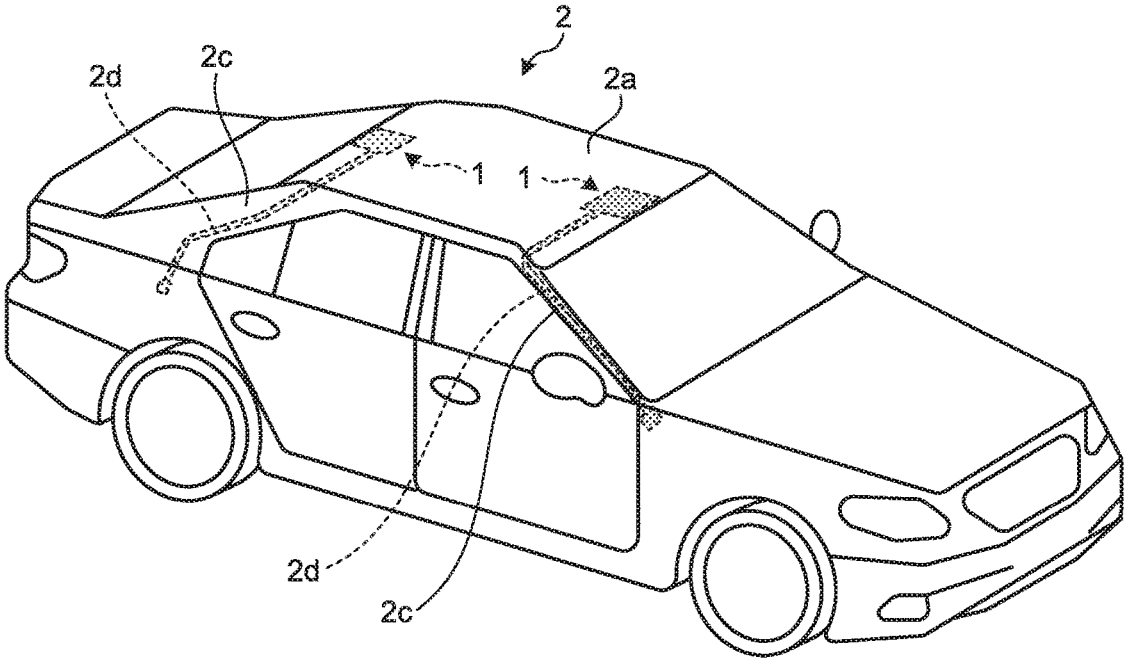
FIG. 1 is a schematic plan view illustrating an example of installation of an antenna unit according to an embodiment.

An antenna unit 1 according to an embodiment will be described. The antenna unit 1 transmits or receives information from the outside of a vehicle 2, as illustrated in FIG. 1. The antenna unit 1 is used as, for example, a global position system (GPS) antenna receiving positioning signals from a GPS communication network via which positions of the vehicle 2 are measured using artificial satellites. The antenna unit 1 is a planar printed circuit body having flexibility. The antenna unit 1 is installed in the vehicle 2 and is installed, for example, at the inner side of a roof panel 2*a* that is an exterior of the vehicle 2 and is made of resin. FIG. 1 illustrates the case in which the antenna unit 1 is installed on the roof panel 2*a* at a front center position of the vehicle 2 and the case in which the antenna unit 1 is installed on the roof panel 2*a* at a rear center position of the vehicle 2, for example. Installation of the antenna unit 1 at the inner side of the roof panel 2*a* has no influence on reception of electric waves because the roof panel 2*a* is made of resin, through which the electric waves are transmitted. As long as at least a portion of the roof panel 2*a* on which planar antennas 11, which will be described later, of the antenna unit 1 are installed is made of the resin, other portions of the roof panel 2*a* may be made of metal. Furthermore, the antenna unit 1 may be installed on a portion other than the roof panel 2*a*. The antenna unit 1 may be installed, for example, at the inner side of an exterior such as a dashboard, a hood, a front door, and a rear door through which the electric waves are transmitted.

Figure 2:
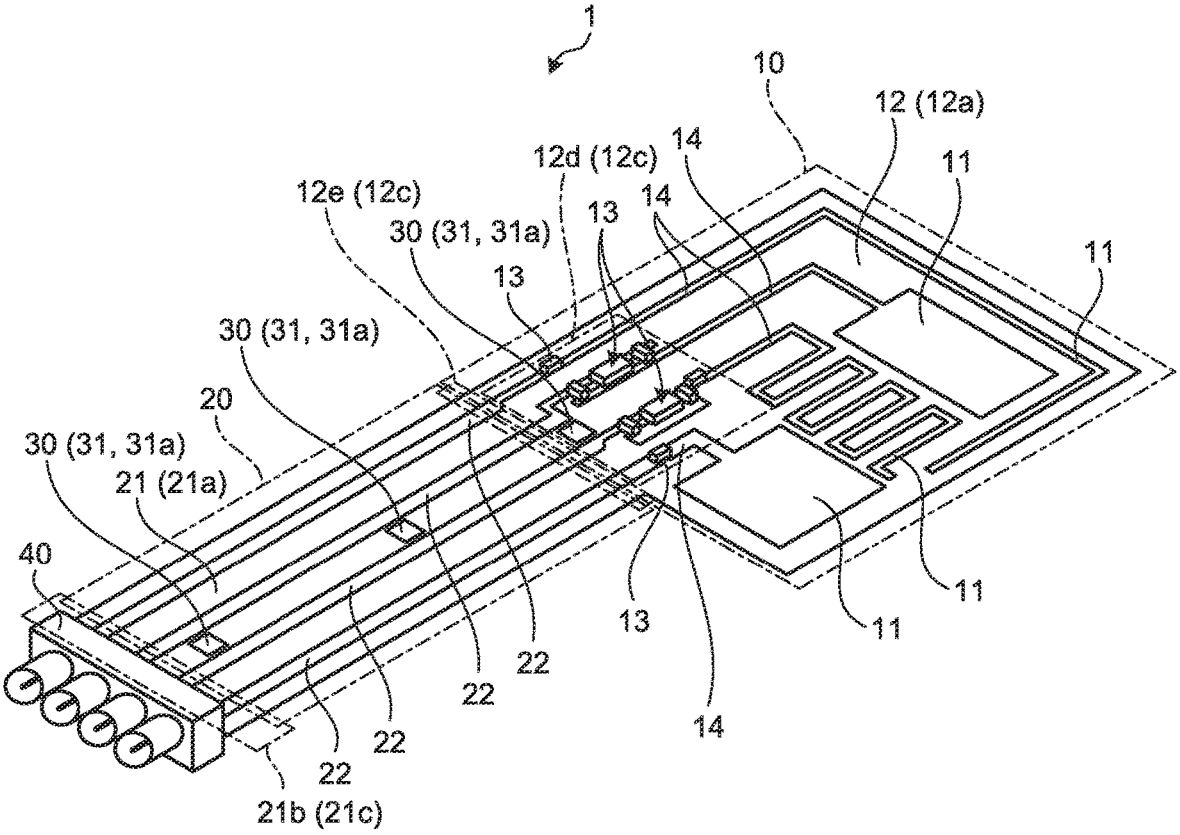
FIG. 2 is a perspective view illustrating an example of the configuration of the antenna unit in the embodiment.

The antenna unit 1 has various patterns formed by, for example, masking portions where copper foil is to be left that is formed on the entire surfaces of mounting surfaces 12*a* and 21*a* (see FIG. 2), which will be described later, and removing copper foil from unnecessary portions by etching. The various patterns include the planar antennas 11, first wiring patterns 14, a ground 15, and second wiring patterns 22, which will be described later. Exposed portions of the various patterns are coated with protection sheets 17 (see FIG. 3) made of resin or the like. This coating enables the antenna unit 1 to protect the various patterns thereof from moisture, foreign matters, and the like. The antenna unit 1 includes a planar antenna portion 10, a planar coaxial line portion 20 serving as a planar wiring portion, position fixing portions 30, and a coaxial connector 40 serving as a connection component.

The planar antenna portion 10 receives, for example, electric waves from the outside of the vehicle 2. The planar antenna portion 10 includes the planar antennas 11, a first base portion 12, and a plurality of electronic components 13 such as an amplifier and a filter.

The planar antennas 11 are antennas that each transmit or receive electric waves having any desired frequency. The planar antennas 11 are installed, for example, at the inner side of the roof panel 2*a* of the vehicle 2, the roof panel 2*a* allowing the electric waves to be transmitted therethrough. The planar antennas 11 each have, for example, antenna patterns formed by the copper foil on the mounting surface 12*a* of the first base portion 12. The respective planar antennas 11 are formed into, for example, square shapes, oblong shapes, or linear shapes, and the lengths of the respective sides thereof are determined in accordance with the wavelength of the electric waves. The planar antennas 11 may have shapes other than the square shapes, the oblong shapes, and the linear shapes, and are appropriately formed in accordance with the electric waves to be received. That is to say, the planar antennas 11 each may have any shape as long as the shape is a planar shape the thickness of which can be reduced to such an extent that the antenna unit 1 can be installed at the inner side of the exterior. Exposed portions of the respective planar antennas 11 are coated with the protection sheet 17 made of resin or the like.

The first base portion 12 is a base member supporting the planar antennas 11. The first base portion 12 is a thin plate-like insulating body (dielectric body) and is formed into a rectangular shape. The first base portion 12 is formed to have higher flexibility and be easier to be curved than the planar antennas 11. The first base portion 12 includes a reinforcing portion 12*c* reinforcing a part of the first base portion 12. The reinforcing portion 12*c* is formed by, for example, a resin member and is formed to be higher in rigidity than portions of the first base portion 12 other than the reinforcing portion 12*c*. It should be noted that a target to be reinforced by the reinforcing portion 12*c* is appropriately set. The electronic components 13, which will be described later, are installed on the mounting surface 12*a* of the first base portion 12. The first wiring patterns 14 that electrically connect the electronic components 13 and the planar antennas 11 together are formed on the first base portion 12. Exposed portions of the respective first wiring patterns 14 are coated with the protection sheet 17 made of resin or the like. The ground 15 is formed on the first base portion 12 at the opposite side to the mounting surface 12*a* thereof on which the planar antennas 11 are provided. The first base portion 12 includes the reinforcing portion 12*c* that reinforces a component mounting portion 12*d* on which the electronic components 13 are mounted, and a conductor connection portion 12*e* connecting the respective wiring patterns 14 and the second wiring patterns 22. The reinforcement with the reinforcing portion 12*c* can prevent generation of cracks due to soldering or the like, thereby improving mountability of the components and ensuring reliability of the connecting portion.

The ground 15 is a ground pattern made of metal such as copper and causes a feedback current to flow therethrough. The ground 15 is formed by any desired pattern that can improve characteristics of the planar antennas 11 and the first wiring patterns 14. The improved characteristics can increase gains of the planar antennas 11 and can reduce loss (transmission loss) of current flowing through the first wiring patterns 14. Exposed portions of the ground 15 are coated with the protection sheet 17 made of resin or the like.

Figure 3:
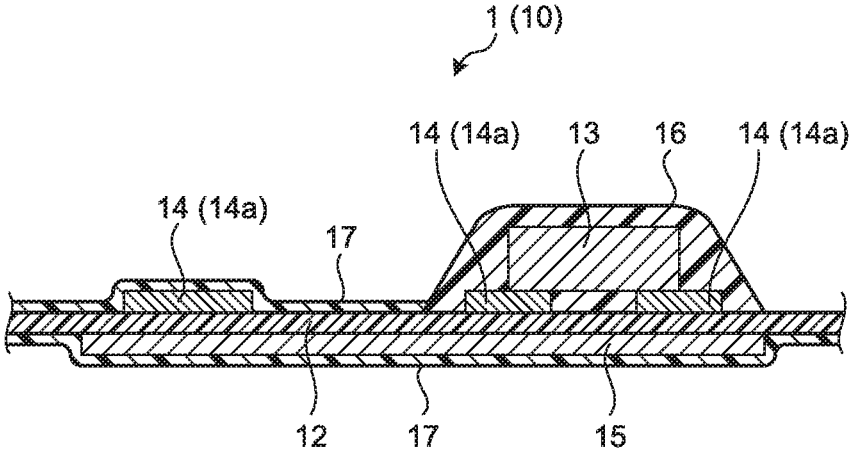
FIG. 3 is a sectional view illustrating an example of the configuration of a part of the antenna unit in the embodiment.

The electronic components 13 are connected to the respective planar antennas 11 through the respective first wiring patterns 14, and remove noise of the current output from the respective planar antennas 11 that have received the electric waves and amplify the current. Furthermore, the electronic components 13 are each connected to the planar coaxial line portion 20 through the second wiring patterns 22, which will be described later, and output the amplified current from which the noise has been removed to the planar coaxial line portion 20. As illustrated in FIG. 3, exposed portions of the respective electronic components 13 are coated with resin portions 16. The electronic components 13 are installed in the vicinity of the respective planar antennas 11. With this installation manner, the antenna unit 1 can reduce the transmission loss between the planar antennas 11 and the electronic components 13, and can easily take a countermeasure for reducing electromagnetic noise with shielding.

The planar coaxial line portion 20 electrically connects the planar antenna portion 10 and the coaxial connector 40 together. The planar coaxial line portion 20 includes a second base portion 21, and the second wiring patterns 22 serving as the conductors.

The second base portion 21 is a base member supporting the second wiring patterns 22 and is connected to the first base portion 12. In this example, the second base portion 21 is integrally formed with the first base portion 12 and extends from an end portion of the first base portion 12 at the side of the respective electronic components 13. The second base portion 21 is a thin plate-like insulating body (dielectric body) and is formed into a rectangular shape. The second base portion 21 is formed to have higher flexibility and be easier to be curved than the planar antennas 11. The second wiring patterns 22 that are electrically connected to the respective electronic components 13 are formed on the mounting surface 21*a* of the second base portion 21. The second base portion 21 includes a reinforcing portion 21*c* reinforcing a part of the second base portion 21. The reinforcing portion 21*c* is formed by, for example, a resin member and is formed to be higher in rigidity than portions of the second base portion 21 other than the reinforcing portion 21*c*. The second base portion 21 includes the reinforcing portion 21*c* that reinforces a connector mounting portion 21*b* connecting together the coaxial connector 40 and the second wiring patterns 22. The reinforcement with the reinforcing portion 21*c* can prevent generation of cracks due to soldering or the like, thereby improving reliability of the connecting portion.

The second wiring patterns 22 are formed into linear shapes and one ends thereof are connected to the respective planar antennas 11 through the respective electronic components 13 and the other ends thereof are connected to the coaxial connector 40. The respective second wiring patterns 22 are, for example, wiring patterns made of metal such as copper, which are formed on the mounting surface 21*a* of the second base portion 21. Exposed portions of the respective second wiring patterns 22 are coated with the protection sheet 17 made of resin or the like.

Figure 4:
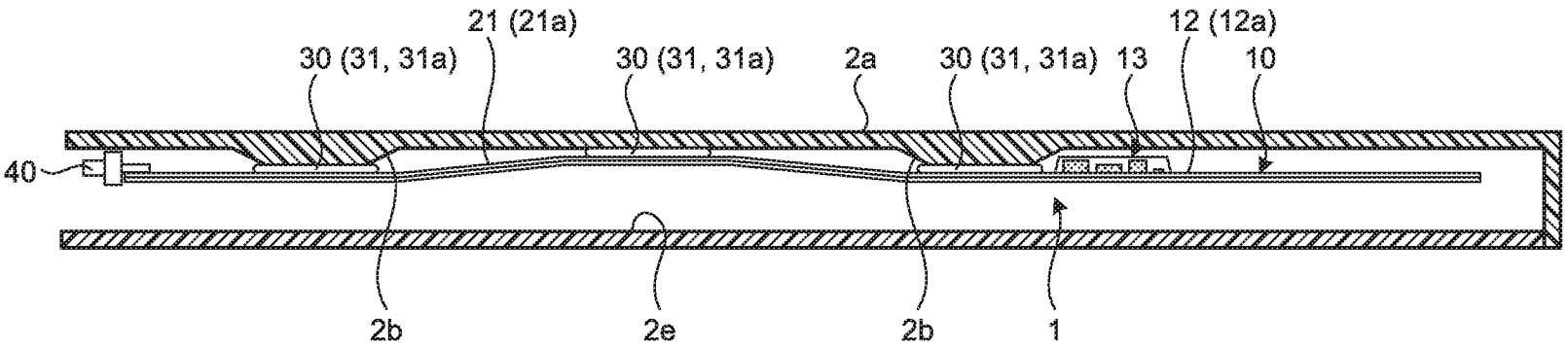
FIG. 4 is a sectional view illustrating an example of the installation of the antenna unit in the embodiment.

The position fixing portions 30 fix the positions of the planar antenna portion 10 and the planar coaxial line portion 20 onto the roof panel 2*a*, for example. The position fixing portions 30 have, for example, mounting portions 31 that mount, at the inner side of the roof panel 2*a*, the planar antenna portion 10 and the planar coaxial line portion 20, as illustrated in FIG. 4. The mounting portions 31 have, for example, a plurality of adhesive members 31*a*. The adhesive members 31*a* are respectively provided on the mounting surfaces 12*a* and 21*a* of the first base portion 12 and the second base portion 21. The roof panel 2*a* made of resin has a plurality of projections 2*b* for bonding the antenna unit 1 to the inner side of the roof panel 2*a*. The adhesive members 31*a* are bonded to the respective projections 2*b* of the roof panel 2*a* and some of the adhesive members 31*a* are bonded directly to the inner surface of the roof panel 2*a*. The antenna unit 1 is therefore fixed to the inner side of the roof panel 2*a* in a state of having a mounting space portion between the inner side of the roof panel 2*a* and the mounting surfaces 12*a* and 21*a*. In the antenna unit 1, for example, the coaxial connector 40 of the antenna unit 1 is electrically connected to a wire harness 2*d* inserted into a pillar 2*c* of the vehicle 2 (see FIG. 1).

As mentioned above, the antenna unit 1 according to the embodiment includes the planar antenna portion 10, the planar coaxial line portion 20, and the position fixing portions 30, in which the planar antenna portion 10 has the planar antennas 11 installed, on the exterior (for example, the roof panel 2*a*) of the vehicle 2 through which electric waves are transmitted, at the inner side of the exterior, and the first base portion 12 supporting the planar antennas 11, the planar coaxial line portion 20 has the second wiring patterns 22 connected to the planar antennas 11, and the second base portion 21 connected to the first base portion 12 and supporting the second wiring patterns 22, and the position fixing portions 30 fix the positions of the planar antenna portion 10 and the planar coaxial line portion 20 onto the exterior. With this configuration, the antenna unit 1 is formed into the planar shape and thus can be reduced in thickness, weight, and size. The antenna unit 1 enables the planar antenna portion 10 and the planar coaxial line portion 20 to be collectively installed. The antenna unit 1 can thereby be properly installed at the inner side of the exterior of the vehicle 2. Furthermore, the antenna unit 1 enables the second wiring patterns 22 of the planar coaxial line portion 20 to be easily wired in the pillar 2*c* or the like. Moreover, the antenna unit 1 is the planar printed circuit body provided by forming a circuit by printing, so that a connecting structure between the planar antenna portion 10 and the planar coaxial line portion 20 can be simplified and electric and mechanical connection performance can be improved.

In the antenna unit 1, the planar antenna portion 10 and the planar coaxial line portion 20 are formed to have high flexibilities and be easy to be curved. The antenna unit 1 is therefore mounted while being curved along the inner shape of the roof panel 2*a* of the vehicle 2, thereby improving mountability. When, for example, the inner side of the roof panel 2*a* has irregularities, the antenna unit 1 can be mounted while the shapes of the planar antenna portion 10 and the planar coaxial line portion 20 are being deformed so as to fit with the irregularities of the roof panel 2*a*. The antenna unit 1 can therefore be mounted even when a space between the roof panel 2*a* and a roof head lining 2*e* is narrow. In other words, the antenna unit 1 enables the space between the roof panel 2*a* and the roof head lining 2*e* to be narrow. The antenna unit 1 thereby enables an in-cabin space of the vehicle 2 to be enlarged. The antenna unit 1 is formed into the planar shape and thus the number of mounting portions 31 (for example, adhesive places) used to mount the planar antenna portion 10 and the planar coaxial line portion 20 on the roof panel 2*a* can be increased. Accordingly, the planar antenna portion 10 and the planar coaxial line portion 20 can be firmly mounted at the inner side of the roof panel 2*a*.

The first base portion 12 includes the reinforcing portion 12*c* that reinforces a part of the first base portion 12, and the reinforcing portion 12*c* is higher in rigidity than the portions of the first base portion 12 other than the reinforcing portion 12*c*. The first base portion 12 reinforces the component mounting portion 12*d* and the conductor connection portion 12*e*, with the reinforcing portion 12*c*. The first base portion 12 can therefore prevent, with the reinforcing portion 12*c*, generation of cracks on portions of the component mounting portion 12*d* on which the electronic components 13 and the first wiring patterns 14 are connected together by soldering or the like and portions of the conductor connection portion 12*e* on which the first wiring patterns 14 and the second wiring patterns 22 are connected together by soldering or the like. The second base portion 21 includes the reinforcing portion 21*c* that reinforces a part of the second base portion 21, and the reinforcing portion 21*c* is higher in rigidity than the portions of the second base portion 21 other than the reinforcing portion 21*c*. The second base portion 21 reinforces the connector mounting portion 21*b* with the reinforcing portion 21*c*. The reinforcement can therefore prevents generation of cracks on portions of the connector mounting portion 21*b* on which the coaxial connector 40 and the respective second wiring patterns 22 are connected together by soldering or the like. As mentioned above, the antenna unit 1 enables the electronic components 13, the coaxial connector 40, and the like to be connected together on the planar antenna portion 10 and the planar coaxial line portion 20 by soldering or the like.

In the antenna unit 1, the first base portion 12 is the insulating body and the ground 15 is formed on the first base portion 12 at the opposite side to the side at which the planar antennas 11 are provided. The ground 15 is formed by the desired pattern that can improve the characteristics of the planar antennas 11 and the first wiring patterns 14. The antenna unit 1 can therefore increase the gains of the respective planar antennas 11 and reduce the loss (transmission loss) of the current flowing through the first wiring patterns 14.

The antenna unit 1 includes the coaxial connector 40 that is connected to the second wiring patterns 22 at the opposite side to the planar antennas 11. The antenna unit 1 can therefore be easily connected to the other electronic components such as the wire harness 2*d* through the coaxial connector 40.

In the antenna unit 1, the position fixing portions 30 have the mounting portions 31 that mount, at the inner side of the exterior, the planar antenna portion 10 and the planar coaxial line portion 20. The antenna unit 1 therefore enables the planar antenna portion 10 and the planar coaxial line portion 20 to be easily fixed to the exterior of the vehicle 2 with the mounting portions 31.

Modifications

Next, modifications of the embodiment will be described. Although the example in which the first base portion 12 and the second base portion 21 are integrally formed has been described, they are not limited to be formed in this manner. The first base portion 12 and the second base portion 21 may be formed as separate bodies. In this case, the first base portion 12 and the second base portion 21 are coupled by a coupling portion (not illustrated). When the first base portion 12 and the second base portion 21 are formed as the separate bodies, wiring patterns on the planar antenna portion 10 and wiring patterns on the planar coaxial line portion 20 are electrically connected together with silver pastes or the like.

Although the example in which the antenna unit 1 is the planar printed circuit body provided by printing the patterns on the thin plate-like insulating bodies has been described, the antenna unit 1 is not limited thereto. The antenna unit 1 may be formed as, for example, a printed circuit body such as a flat cable (what is called FC), a flexible flat cable (what is called FFC), a flexible print circuit substrate (what is called FPC), and a membrane wiring board. Alternatively, in the antenna unit 1, wirings may be formed by metal bars, busbars, or the like provided by applying insulating coating onto bar members having conductive flexibility.

The antenna unit 1 may have the planar antenna portion 10 formed by the planar printed circuit body and the planar coaxial line portion 20 formed by a flexible substrate having higher flexibility than the planar printed circuit body. With this configuration, the antenna unit 1 can improve wiring performance of the planar coaxial line portion 20 and stably hold the planar antennas 11 and the electronic components 13.

Figure 5:
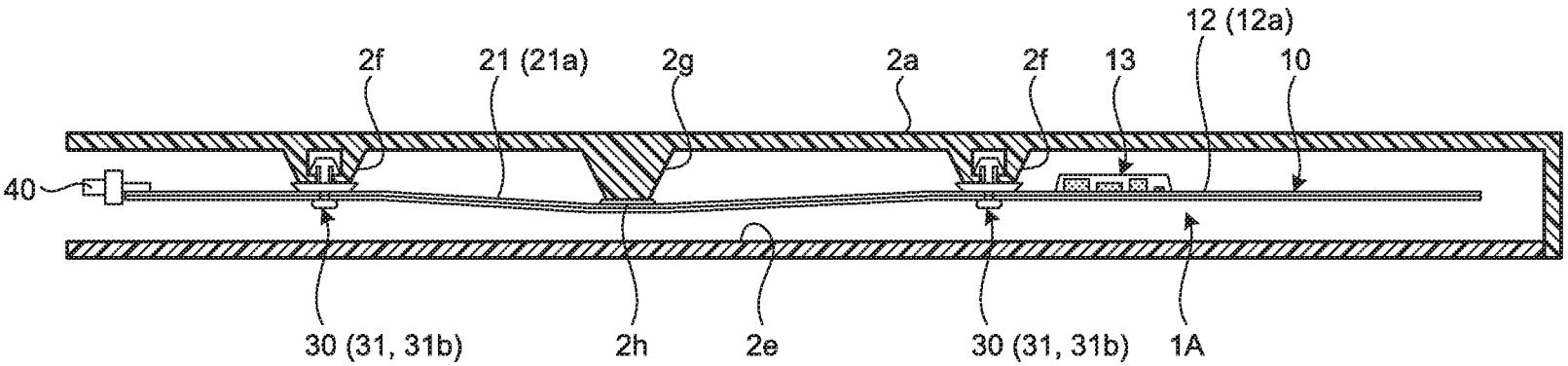
FIG. 5 is a sectional view illustrating an example of installation of an antenna unit according to a modification.

Furthermore, the mounting portions 31 are not limited to be formed by the respective adhesive members 31*a*. The mounting portions 31 may be, for example, resin bolts, Velcro (registered trademark) tapes, or adhesives containing hot melt. The mounting portions 31 may have, for example, a plurality of clamp members 31*b*, as illustrated in FIG. 5. The clamp members 31*b* are provided on the respective mounting surfaces 12*a* and 21*a* of the first base portion 12 and the second base portion 21. The roof panel 2*a* made of resin is provided with a plurality of clamp receivers 2*f* for mounting the clamp members 31*b* at the inner side of the roof panel 2*a* and interference prevention projections 2*g* for preventing the roof panel 2*a* from interfering with the mounting surface 21*a*. Cushioning materials 2*h* for moderating impact between the interference prevention projections 2*g* and the mounting surface 21*a* are provided on the front ends of the interference prevention projections 2*g*. When an antenna unit 1A is mounted at the inner side of the roof panel 2*a*, the clamp members 31*b* are mounted on the respective clamp receivers 2*f* of the roof panel 2*a*. In this case, the interference prevention projections 2*g* form a mounting space portion between the inner side of the roof panel 2*a* and the mounting surface 21*a* to prevent the roof panel 2*a* from interfering with the mounting surface 21*a*. The antenna unit 1A may be fixed to the inner side of the roof panel 2*a* using the clamp receivers 2*f* in this manner. The antenna unit 1 may be fixed to the roof head lining 2*e* although not illustrated in the drawing. In this case, fixing portions (not illustrated) provided on the roof head lining 2*e* function as the mounting portions 31.

The antenna unit according to the embodiment includes a planar antenna portion, a planar wiring portion, and a position fixing portion. The planar antenna portion includes a planar antenna installed at the inner side of an exterior of a vehicle, the exterior allowing electric waves to be transmitted therethrough, and a first base portion supporting the planar antenna. The planar wiring portion includes a conductor formed into a linear shape and connected to the planar antenna, and a second base portion connected to the first base portion and supporting the conductor. The position fixing portion fixes positions of the planar antenna portion and the planar wiring portion to the exterior. With this configuration, the antenna unit enables the planar antenna portion and the planar wiring portion to be collectively installed, thereby being properly installed at the inner side of the exterior of the vehicle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An antenna unit comprising:

a planar antenna portion that includes a plurality of planar antennas installed at an inner side of an exterior of a vehicle, the exterior allowing electric waves to be transmitted therethrough, the plurality of planar antennas transmitting or receiving the electric waves, and a first base portion supporting the plurality of planar antennas, the plurality of planar antennas being patterned on the first base portion;

a planar wiring portion that includes a plurality of conductors, each formed into a linear shape and connected to a different one of the plurality of planar antennas, and a second base portion connected to the first base portion and supporting the plurality of conductors; and a position fixing portion that fixes positions of the planar antenna portion and the planar wiring portion to the exterior, wherein at least one of the first base portion or the second base portion has a higher flexibility than the plurality of planar antennas and is configured to be bendable for mounting on the vehicle, and wherein the plurality of conductors extend in parallel and linear along the same extending direction.

2. The antenna unit according to claim 1, wherein at least one of the first base portion and the second base portion includes a reinforcing portion, and the reinforcing portion is higher in rigidity than portions of at least one of the first base portion and the second base portion other than the reinforcing portion.

3. The antenna unit according to claim 2, wherein the first base portion is an insulating body and a ground is formed on the first base portion at a side opposite to a side at which the plurality of planar antennas is provided.

4. The antenna unit according to claim 3, further comprising:

a connection component connected to the plurality of conductors at a side opposite to plurality of planar antennas.

5. The antenna unit according to claim 3, wherein the position fixing portion includes a mounting portion that mounts, at the inner side of the exterior, the planar antenna portion and the planar wiring portion.

6. The antenna unit according to claim 2, further comprising:

a connection component connected to the plurality of conductors at a side opposite to the plurality of planar antennas.

7. The antenna unit according to claim 6, wherein the position fixing portion includes a mounting portion that mounts, at the inner side of the exterior, the planar antenna portion and the planar wiring portion.

8. The antenna unit according to claim 2, wherein the position fixing portion includes a mounting portion that mounts, at the inner side of the exterior, the planar antenna portion and the planar wiring portion.

9. The antenna unit according to claim 2, further comprising:

one or more electronic components formed on the reinforcing portion, and wherein the reinforcing portion is higher in rigidity than other portions of the first base portion on which the plurality of antennas is formed.

10. The antenna unit according to claim 1, wherein the first base portion is an insulating body and a ground is formed on the first base portion at a side opposite to a side at which the plurality of planar antennas is provided.

11. The antenna unit according to claim 10, further comprising:

a connection component connected to the plurality of conductors at a side opposite to the plurality of planar antennas.

12. The antenna unit according to claim 11, wherein the position fixing portion includes a mounting portion that mounts, at the inner side of the exterior, the planar antenna portion and the planar wiring portion.

13. The antenna unit according to claim 10, wherein the position fixing portion includes a mounting portion that mounts, at the inner side of the exterior, the planar antenna portion and the planar wiring portion.

14. The antenna unit according to claim 1, further comprising:

a connection component connected to the plurality of conductors at a side opposite to the plurality of planar antennas.

15. The antenna unit according to claim 14, wherein the position fixing portion includes a mounting portion that mounts, at the inner side of the exterior, the planar antenna portion and the planar wiring portion.

16. The antenna unit according to claim 1, wherein the position fixing portion includes a mounting portion that mounts, at the inner side of the exterior, the planar antenna portion and the planar wiring portion.

17. The antenna unit according to claim 1, wherein the plurality of planar antennas are directly patterned on the first base portion.

18. The antenna unit according to claim 1, wherein each of the plurality of planar antennas is a copper foil patterned directly on the first base portion.

19. The antenna unit according to claim 1, wherein the second base portion is integrally formed with the first base portion.

20. The antenna unit according to claim 1, wherein the plurality of conductors comprise wiring patterns formed directly on the second base portion.

* * * * *